US006516176B1

(12) United States Patent
Yoshida

(10) Patent No.: US 6,516,176 B1
(45) Date of Patent: Feb. 4, 2003

(54) TRANSFERRING BODY APPARATUS WITH ELASTIC MEMBER COVERING SURFACE OF BASE OF THE TRANSFERRING BODY APPARATUS

(75) Inventor: Minoru Yoshida, Machida (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/927,388

(22) Filed: Aug. 13, 2001

(51) Int. Cl.[7] ..... G03G 15/01; G03G 15/16
(52) U.S. Cl. ..... 399/302
(58) Field of Search ..... 399/302, 308

(56) References Cited

U.S. PATENT DOCUMENTS

| | | | | |
|---|---|---|---|---|
| 5,187,526 A | | 2/1993 | Zaretsky | 355/273 |
| 5,666,599 A | | 9/1997 | Miyasaka et al. | 399/162 |
| 5,669,052 A | * | 9/1997 | Kusaba et al. | 399/308 |
| 5,710,964 A | * | 1/1998 | Tombs et al. | 399/308 X |
| 5,950,058 A | * | 9/1999 | Kusaba et al. | 399/302 |
| 5,974,281 A | * | 10/1999 | Fujii et al. | 399/302 X |
| 6,144,830 A | * | 11/2000 | Kusaba et al. | 399/302 |
| 6,175,712 B1 | * | 1/2001 | Masuda et al. | 399/302 |

FOREIGN PATENT DOCUMENTS

| | | | |
|---|---|---|---|
| JP | 9146385 | | 6/1997 |
| JP | 10-39659 | * | 2/1998 |
| JP | 10-186875 | * | 7/1998 |

* cited by examiner

*Primary Examiner*—Fred L. Braun
(74) *Attorney, Agent, or Firm*—Foley & Lardner

(57) ABSTRACT

A transferring body apparatus has a cylindrical base and an elastic member covering the cylindrical base therewith on which an image is transferred. The elastic member has a hardness (JIS-A) of 60 to 80 degrees, a thickness of 0.2–0.8 mm, a tensile stress of 40 kgf/cm$^2$ or more. Assuming an outer diameter of the base is an inner diameter of the elastic member is r, $1.03 \leqq R/r \leqq 1.15$ is R, and satisfied. Assuming a surface roughness of the outer surface of the base is S1 $\mu$m Rz, and a surface roughness of the inner surface of the elastic member is S2 $\mu$m Rz, S1+S2$\leqq$12, S1$\leqq$5, is satisfied.

11 Claims, 4 Drawing Sheets

TRANSFERRING BODY APPARATUS WITH ELASTIC MEMBER COVERING SURFACE OF BASE OF THE TRANSFERRING BODY APPARATUS

BACKGROUND OF THE INVENTION

The present invention relates to a transferring body apparatus installed in a copying machine as an application of a color electronic photograph or a printer.

There are various types of printing methods for use in a color electronic copying machine, one of which is a method of overlapping toner images in colors on a photosensitive body, or an intermediate transferring body, or a sheet.

According to the method of overlapping toner images in colors on a photosensitive body, exposing needs to be performed on toner images, and thus a considerable problem will occur in image quality.

According to the method of overlapping toner images on an intermediate transferring body, two transfer steps are needed: a primary transfer step for transferring a toner image from a photosensitive body to the intermediate transferring body; and a secondary transfer step for transferring a toner image from the intermediate transferring body to a sheet.

According to the method of overlapping toner images on a sheet, a toner image is transferred from a photosensitive body directly to the sheet, and thus the primary and secondary transfer steps as needed for the intermediate transferring body method do not need to be performed. Therefore, this method has been generally employed in various color copying machines.

On the other hand, the intermediate transferring body method is thought to be unsuitable if a high quality image is desired. This method is, however, advantageous in space efficiency since the intermediate transferring body can be formed in a belt, or a thick sheet, and thus employed in a machine such as a color printer for which the image quality is not the highest priority.

The intermediate transferring body can be formed in a form other than a belt, for example, in a drum. The intermediate transferring body formed in a drum (hereinafter referred to as "the intermediate transferring drum") is formed by covering a surface of a metal drum with a rubber belt. If the rubber belt slips over the metal drum, the toner images shift from each other, or the rubber belt twists to rise, which causes a trouble in an image transfer or results in an uneven image transfer. Especially, when the intermediate transferring body has no driving source, a large force will be applied to the surface of the intermediate transferring body in the driving of a photosensitive body.

Even if the driving means for driving the intermediate transferring body at a speed equal to that of the photosensitive body, when a blade contacting the intermediate transferring body is used as a cleaner of the intermediate transferring body, a large load is applied to the rubber belt, thereby the rubber belt may slip or shift.

In order to prevent slippage between the metal drum and the rubber belt, an adhesive agent is filled between the metal drum and the rubber belt when the metal drum is covered with the rubber belt.

In using the adhesive agent, however, if the adhesive agent is not applied evenly, the surface of the intermediate transferring body is made uneven, thereby uneven image transfer will occur. The yield cannot be increased thereby, and thus mass-production cannot be attained with ease.

If the metal base of the intermediate transferring body can be covered with the rubber belt without any adhesive agent, a uniform transfer and an improvement of the yield can be attained. In order to prevent slippage between the base and the rubber belt without an adhesive agent, the best way is to extend a rubber belt having high elasticity to cover the metal base. However, the winding of a very hard rubber belt having a small diameter onto the metal drum will terribly deteriorate the manufacturing efficiency, and thus mass-production cannot be attained.

Even if slippage does not occur between the metal base and the rubber belt in an early stage of use, when the machine is not used for a long period of time, or when the end of the life of the intermediate transfer body is approaching, the rubber belt will become slack, resulting in the slip between the metal base and the rubber belt.

BRIEF SUMMARY OF THE INVENTION

The present invention is made in consideration of the above, and is intended to provide an intermediate transfer body which does not deteriorate the manufacturing efficiency even if the base is covered with an elastic member without an adhesive agent, and prevents the slip between the base and the elastic member for a long period of time.

The transferring body apparatus of the present invention comprises a cylindrical base and an elastic member covering the cylindrical base therewith to which an image is transferred, wherein the elastic member has a hardness (JIS-A) of 60 to 80 degrees, a thickness of 0.2–0.8 mm, a tensile stress of 40 kgf/cm$^2$ or more, supposing an outer diameter of the base is R, and an inner diameter of the elastic member is r, $1.03 \leqq R/r \leqq 1.15$ is satisfied, and supposing a surface roughness of the outer surface of the base is S1 $\mu$m Rz, and a surface roughness of the inner surface of the electric member is S2 $\mu$m Rz, S1+S2$\leqq$12, S1$\leqq$5 are satisfied.

The transferring body apparatus of the present invention comprises a cylindrical base and an elastic member covering the cylindrical base therewith to which an image is transferred, wherein the elastic member has a hardness (JIS-A) of 60 degrees or less, a thickness of 0.2–0.8 mm, a tensile stress of 40 kgf/cm$^2$ or more, supposing an outer diameter of the base member is R, and an inner diameter of the elastic member is r, $1.03 \leqq R/r \leqq 1.15$ is satisfied, and supposing a surface roughness of the outer surface of the base is S1 $\mu$m Rz, and a surface roughness of the inner surface of the elastic member is S2 $\mu$m Rz, S1+S2$\leqq$30, S1$\leqq$10 are satisfied.

The transferring body apparatus of the present invention comprises a cylindrical base and an elastic member covering the cylindrical base therewith to which an image is transferred, wherein the elastic member has a hardness (JIS-A) of 80 degrees or less, a thickness of 0.2–0.8 mm, a tensile stress of 40 kgf/cm2 or more, supposing an outer diameter of the base is R, and an inner diameter of the elastic member is r, $1.03 \leqq R/r \leqq 1.15$ is satisfied, and supposing a surface roughness of the outer surface of the base is S1 $\mu$m Rz, and a surface roughness of the inner surface of the elastic member is S2 $\mu$m Rz, S1+S2$\leqq$30, S1$\leqq$10 are satisfied.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be explained with reference to the embodiments shown in the accompanying drawings.

Figure 1:
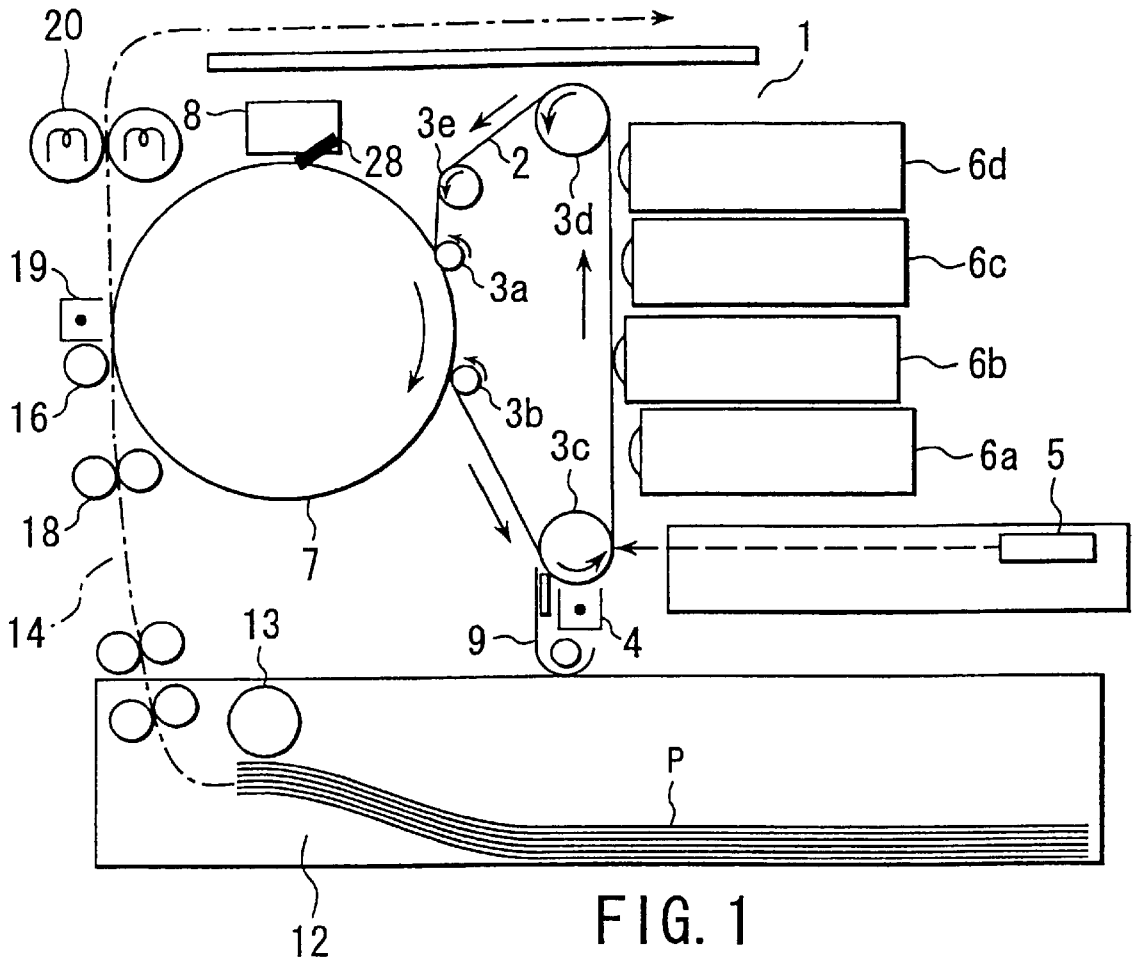
FIG. 1 is a configuration view showing a color electronic copying machine according to the first embodiment of the present invention.

FIG. 1 is a schematic view showing a color electronic copying machine as an image forming apparatus according to the first embodiment of the present invention.

The color electronic copying machine is provided with an image forming section 1. The image forming section 1 has a photosensitive body belt 2 as an image carrier. The photosensitive body belt 2 is stretched between a plurality of first to fifth rollers 3*a* to 3*e* with a predetermined tension and runs in a direction shown by arrows.

In the vicinity of the photosensitive body belt 2, there are arranged in the running direction of the photosensitive body belt 2, a charging device 4 for charging the photosensitive body belt 2 at a predetermined potential, an exposing device 5 for forming an electrostatic latent image on the charged photo-sensitive body belt 2, first to fourth developing devices 6*a* to 6*d* for visualizing the electrostatic latent image by supplying the electrostatic latent image formed on the photosensitive body belt 2 with toner. There are further provided in the vicinity of the photosensitive body belt 2 an intermediate transfer body 7 for temporarily holding the toner image formed on the photosensitive body belt 2 in the running direction, and a cleaner for removing toner left on the photosensitive body belt 2. The intermediate transfer body 7 is also provided with a cleaner 8 for cleaning the intermediate transfer body 7 above the intermediate transfer body 7.

The photosensitive body belt 2 touches the outer circumference of the intermediate transfer body 7 at the portion between the first and the second rollers 3*a* and 3*b*. In the portion between the third and the fourth rollers 3*c* and 3*d*, the photosensitive body belt 2 faces the developing devices 6*a* to 6*d* at a distance from them.

One of the first to fifth rollers 3*a* to 3*e* is connected with the driving motor (not shown), and rotatedly driven at a speed by the rotation of the driving motor in the direction shown by arrows.

On the other hand, there is provided below the image forming section 1 a sheet cassette 12 containing sheets P of a predetermined size as members to which the image is transferred. The sheet cassette 12 is provided with a sheet feeding roller 13 for feeding the sheets P one by one.

There is arranged between the sheet cassette 12 and the intermediate body 7, a transportation system 14 for transporting the sheets P toward the intermediate transfer body 7. The transportation system 14 is provided with a transfer roller 16 facing the intermediate transfer body 7 so as to transfer the toner image onto a sheet P.

On the upstream side in the sheet transporting direction of the transfer roller 16, there is provided an aligning roller 18. The aligning roller 18 temporarily stops the sheet P transported by the transporting system to adjust the angle of the sheet P and align the front end of the sheet P and the front end of the toner image on the intermediate transfer body 7.

On the downstream side in the sheet transporting direction of the transfer roller 16, there are provided a peeling device 19 for applying the sheet P with an AC charge to peel the sheet P off the intermediate transfer body 7, and a fixing device 20 for fixing the toner image transferred to the sheet P onto the sheet P.

The description of the full-color printing operation of the color electronic photographing machine mentioned above will be presented below.

At first, the surface of the rotating photosensitive body belt 2 is uniformly charged at a predetermined potential by the charging device 4. Subsequently, the exposing device 5 performs the exposure corresponding to a yellow image on the photosensitive body belt 2 to form an electrostatic latent image thereon. The electrostatic latent image on the photosensitive body belt 2 is developed with yellow toner supplied by a yellow developing device 6*a*, and the developed image is transferred onto the intermediate transfer body 7. After transferring the developed image, the photosensitive body belt 2 is peeled from the intermediate transfer body 7 and photodischarged by a discharger (not shown). The toner not transferred to the intermediate transfer body 7, remaining on the photosensitive body belt 2, is removed by the cleaner 9. The removed toner is collected in a toner disposal box (not shown).

After the development of the yellow image has finished, the photosensitive body belt 2 is recharged by the charging device 4, and the exposing device 5 performs the exposure corresponding to a magenta image on the photosensitive body belt 2 to form an electrostatic latent image thereon. The electrostatic latent image on the photosensitive body belt 2 is developed with magenta toner supplied by a magenta developing device 6*b*, and the developed image is transferred onto the intermediate transfer body 7 so as to overlap the yellow image. After the same processes are performed for a cyan image and a black image, a four-color overlapping image is formed on the intermediate transfer body 7.

After forming the four-color overlapping image, a sheet P is fed between the intermediate transfer body 7 and the transfer roller 16 so as to perform a secondary transfer of the four-color overlapping image onto the sheet P. The sheet P carrying the four-color overlapping image is peeled from the intermediate transfer body 7 by the peeling device 19, reaches the fixing device 20, and the color image is obtained by the fixing process of the fixing device 20.

On the other hand, the toner not transferred to the sheet P remains on the intermediate transfer body 7, and is removed by applying the cleaner 8 to the intermediate transfer body 7 after the secondary transfer has finished.

The cleaner 8 is placed away from the intermediate transfer body 7 during the forming of the four-color overlapping image on the intermediate transfer body 7.

The intermediate transfer body 7 and the photosensitive body belt 2 are separately rotated with high precision by stepping motors (not shown). By rotating the intermediate transfer body 7 and the photosensitive body belt 2 in this manner, the rotating speeds of the intermediate transfer body 7 and the photosensitive body belt 2 can be set equal, and a color image with little color shift can be formed.

The cleaner 8 for the intermediate transfer body 7 has a cleaning blade 28. The pressing force against the intermediate transfer body 7 is set at a line pressure 1.7 g/cm.

Next, the intermediate transfer body 7 will be described in detail.

Figure 2:
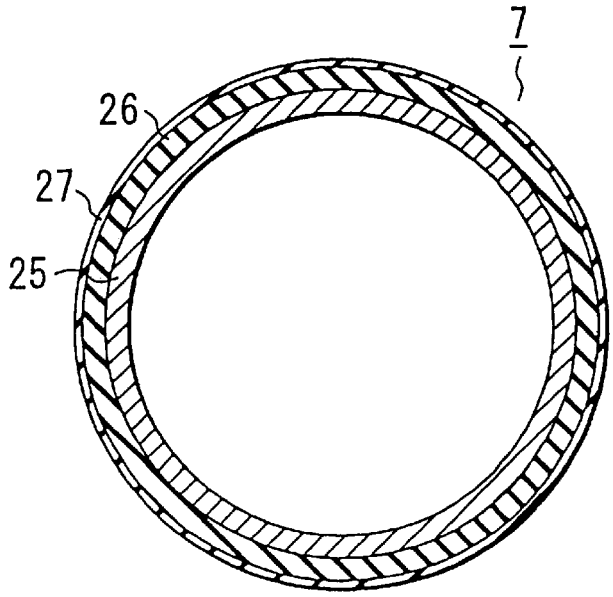
FIG. 2 is a longitudinal sectional view showing an intermediate transfer body.
Figure 3:
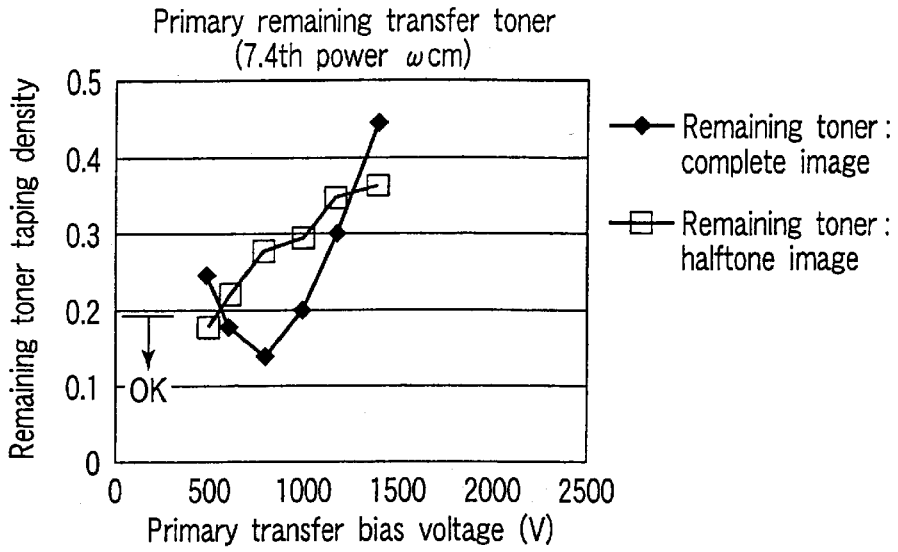
FIG. 3 is a graph representing remaining toner taping concentration.
Figure 4:
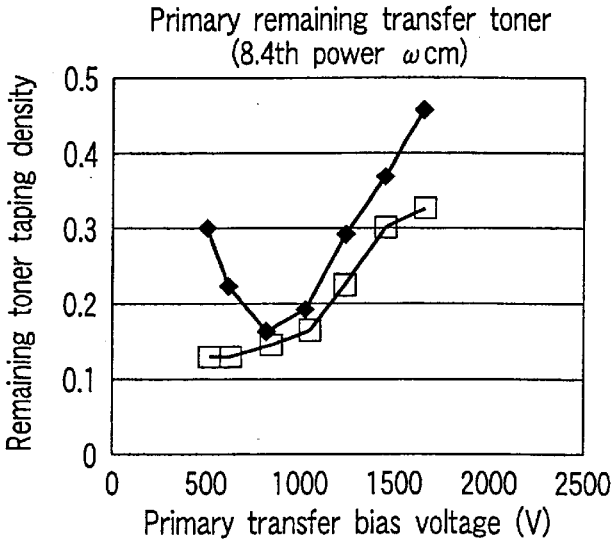
FIG. 4 is a graph representing remaining toner taping concentration.
Figure 5:
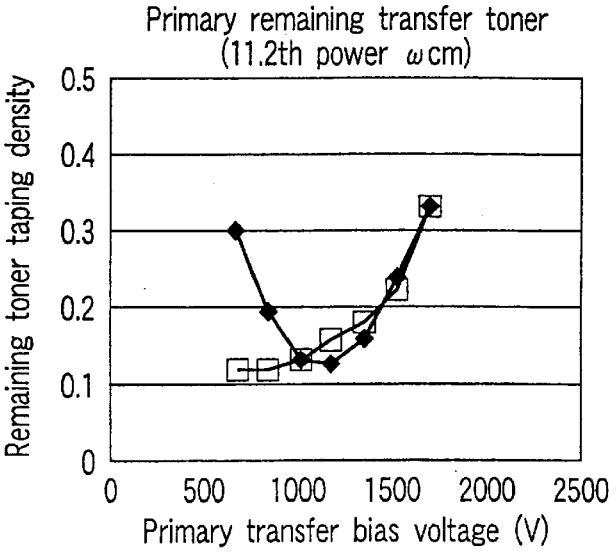
FIG. 5 is a graph representing remaining toner taping concentration.
Figure 6:
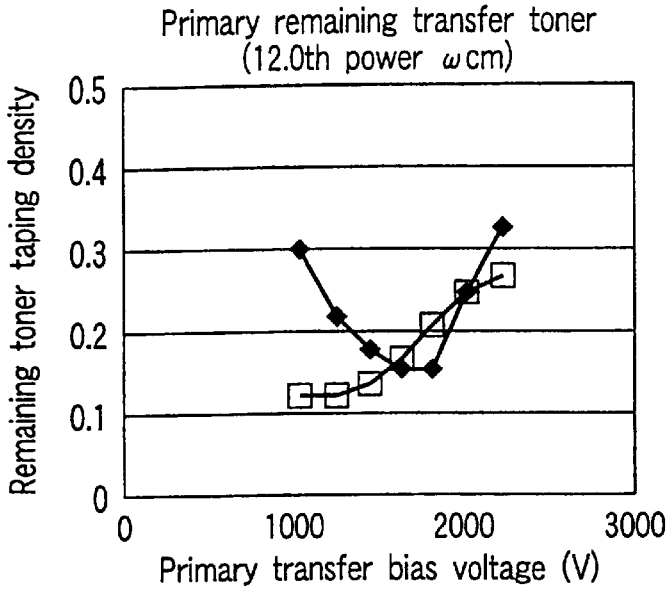
FIG. 6 is a graph representing remaining toner taping concentration.
Figure 7:
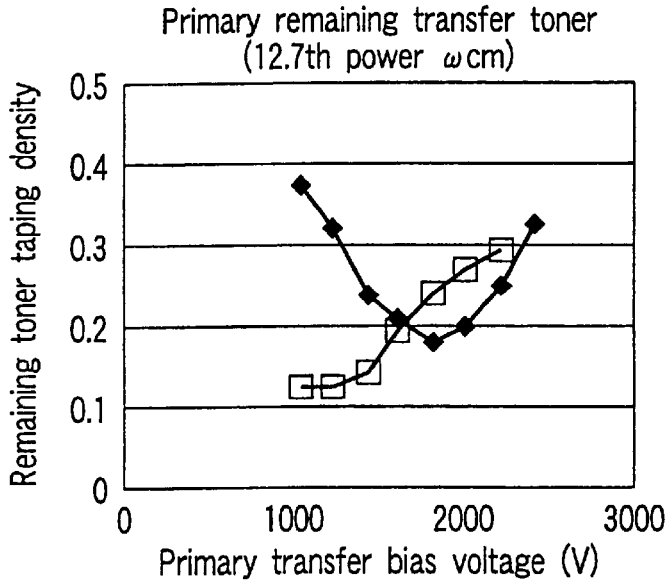
FIG. 7 is a graph representing remaining toner taping concentration.
Figure 8:
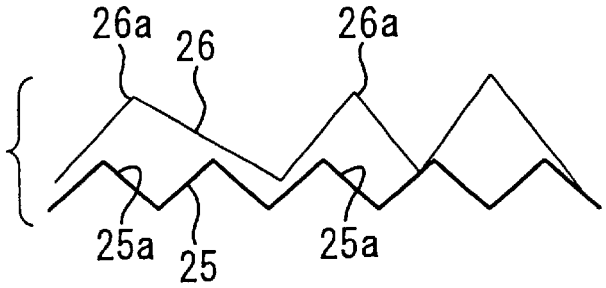
FIG. 8 is a sectional view showing the surface roughness of the aluminum drum of the intermediate transfer body and the rubber belt.

As shown in FIG. 2, the intermediate transfer body 7 has an aluminum drum 25 having an outer diameter ϕ 169 mm as a base, which is covered with a rubber belt 26 having a thickness t 0.5 mm as an elastic member. The outer diameter ϕ of the intermediate transfer body 7 after covering the aluminum drum with the rubber belt 26 is set around 170 mm. The rubber belt 26 stretches and thus the outer diameter ϕ of the intermediate transfer body 7 is a little less than 170 mm.

The rubber belt 26 may be formed of chloroprene rubber, EPDM, urethane, NBR, and silicone or elastomer, the surface of which is applied with fluorocarbon resin, Teflon resin, nylon paint, or urethane paint, to secure a good toner releasing efficiency. In this embodiment, chloroprene rubber is coated with fluorocarbon resin 27, to 10 μm thickness.

The graphs of FIGS. 3 to 7 represent the relationship between the resistance of the intermediate transfer body 7 and the amount of toner (hereinafter referred to as "remaining transfer amount" [complete portion, halftone portion]) remaining on the photosensitive body belt 2 after the primary transfer.

The resistance of the intermediate transfer body 7 is measured with a HIRESTER manufactured by MITSUBISHI CHEMICAL CORPORATION (probe: HRSS, and 500V is applied for 30 seconds).

The remaining transfer amount is a density value (with use of a Macbeth illuminometer) measured by developing magenta toner 0.7 mg/cm$^2$ at the complete portion and 0.25 mg/cm$^2$ at the halftone portion, taping the remaining transfer toner remaining on the photosensitive body belt 2 immediately after the primary transfer, and adhering the tape on a white paper.

The graphs represent that proper transfer can be performed when the volume resistance value of the intermediate transfer body 7 is set within a scope of $10^8$ Ω to $10^{12}$ Ωcm, although the proper bias values differ from each other.

Table 1 (shown in page 22) represents the relationship between the hardness (JIS-A) of the rubber belt 26 and the fall in a line image.

In this research, a urethane sponge roller of 35 degrees (ASKER-C) is used as the secondary transfer roller 16, and the transfer pressure is changed within a scope of 7 to 30 g. In this condition, the printing of the vertical line (sub-scanning line) having a width of 300 μm at which the fall may occur easily the most, and the evaluation of the fall is performed by sight ("○" in the table represents "satisfies the requirement").

The table shows that a good image without fall can be obtained when the hardness of the rubber belt 26 is 80 degree or less although the limit hardness changes by the applied secondary transfer pressure.

Next, the shift between the aluminum drum 25 of the intermediate transfer body 7 and the rubber belt 26 will be described below.

If a shift occurs between the aluminum drum 25 and the rubber belt 26, the rubber belt 26 will rise at the shifted portion, at which the surface of the intermediate transfer body 7 does not contact with the photosensitive body belt 2, resulting in uneven image transfer.

For example, a rubber belt 26 having low elasticity (100% tensile stress: 400 N/cm$^2$) is formed to have an inner diameter (r) ϕ 166 mm, and wound onto the aluminum drum 25 having an outer diameter (R) ϕ 169 mm. In printing with use of the intermediate transfer body 7 formed in such a manner (R/r=1.018), wrinkles are immediately generated on the surface of the intermediate transfer body 7, and an uneven image transfer occurs.

This is thought to be due to a large force that is applied to the surface of the intermediate transfer body 7 at the start of rotation of the photosensitive drum 2, the wrinkles being generated on the intermediate transfer body 7 since the absorption force between the rubber belt 26 and the aluminum drum 25 is weaker than the force.

The absorption force between the rubber belt 26 and the aluminum drum 25 is determined by the fastening force caused by the elasticity of the rubber belt 26 and the friction coefficient between the inner surface of the rubber belt 26 and the outer surface of the aluminum drum 25.

The friction coefficient is dependent also on the material of the rubber belt 26, but mainly determined by the surface roughness of the outer surface of the aluminum drum 25 and the inner surface of the rubber belt 26. The fastening force of the rubber belt 26 is determined by the elasticity of the rubber belt 26 and the ratio of the inner diameter of the rubber belt 26 and the outer diameter of the aluminum drum 25.

Tables 2 to 4 (shown in page 23, 24) represent the evaluation of the occurrence of rise of the rubber belt 26, shift, and uneven image transfer in printing a complete image on 100 sheets serially with use of samples having hardness within a scope of 40–80 degrees and a 100% tensile stress by changing the ratio of the inner diameter of the rubber belt 26 and the outer diameter of the aluminum drum 25.

The surface roughness S2 of the inner surface of the rubber belt 26 is fixed at 3 to 5 μm Rz, and the surface roughness S1 of the outer surface the aluminum drum 25 is fixed at 2 μm Rz.

The ratio P=R/r of the inner diameter of the rubber belt 26 and the outer diameter of the aluminum drum 25 is set within a scope of 1.01–1.20 as a parameter.

As should be clear from the result represented in the tables, the rise of the rubber belt 26 and the uneven image transfer due to the shift occurring when the 100% tensile stress of the rubber belt 26 is small and the ratio P is also small. However, when the ratio P is too large, an uneven image transfer due to the shift similarly occurs. This is not caused by the shift but caused by the slack of the rubber belt 26 which is generated since the rubber belt 26 is overstretched, and looses elasticity in parts thereof. More specifically, if the 100% tensile stress of 40 kgf/cm$^2$ or less is used when the ratio P is 1.03 or less, the rise of the rubber belt 26 and an uneven image transfer due to the shift occurs, and if the ratio P is more than 1.15, an uneven image transfer due to the slack occurs.

From the above-mentioned results obtained from the researches, it is found that good fastening force can be attained when the rubber belt 26 having the hardness of 80 degree or less and the 100% tensile stress of 40 kgf/cm$^2$ or more is used when the ratio P of the inner diameter of the rubber belt 26 and the outer diameter of the aluminum drum 25 is set within a scope of 1.03–1.15.

The following is the description of the research regarding the thickness of the rubber belt 26.

If the thickness of the rubber belt 26 exceeds 0.8 mm, it becomes difficult to cover the aluminum drum 25 therewith. Further, if a slack is generated due to twisting, such a slack cannot be removed. The apparatus with such a thick rubber belt cannot be easily manufactured. On the contrary, if the rubber belt 26 is too thin, an uneven image transfer due to the shift generated between the rubber belt 26 and the aluminum drum 25 occurs when the printing is performed after a long period of time has passed.

Table 5 (shown in page 24) represents the evaluation of the occurrence of an uneven image transfer due to the shift of the rubber belt 26 in printing 100 sheets serially at an early stage after distribution and after leaving for one month, with use of samples having a hardness at 76 degrees and a 100% tensile stress of 100 kgf/cm$^2$ when the ratio R/r is 1.12 and the surface roughness S1 of the outer surface of the aluminum drum 25 is fixed at 3 $\mu$m Rz, and the surface roughness S2 of the inner surface of the rubber belt 26 is fixed at 8 $\mu$m Rz, and the thickness of the rubber belt 26 is set within a range of 0.1 to 0.8 mm. Under the condition where the thickness of the rubber belt 26 is 0.2 nun or less, the uneven image transfer occurs after one month leaving although no problem occurs in the early stage.

As should be clear from the above, the suitable scope of the thickness of the rubber belt 26 is 0.2–0.8 mm.

Next, the friction between the rubber belt 26 and the aluminum drum 25 will be studied.

Tables 6 and 7 (shown in page 25, 26) represent the evaluation of the occurrence of an uneven image transfer due to rise and shift of the rubber belt 26 in printing a complete image on 100 sheets serially with use of samples having a hardness at 64 and 78 degrees and a thickness 0.5 mm, a 100% tensile stress of 50 kgf/cm$^2$ are used when the ratio P of the inner diameter of the rubber belt 26 and the outer diameter of the aluminum drum 25 is set at 1.05 and the surface roughness S1 of the aluminum drum 25 is changed within a scope of 2 to 20 $\mu$m Rz, and the surface roughness S2 of the inner surface of the rubber belt 26 is changed within a scope of 2 to 30 $\mu$m Rz, by sandblasting or the like the outer surface of the aluminum drum 25 and the inner surface of the rubber belt 26.

In a condition where the aluminum drum 25 has a good surface of 5 $\mu$m Rz or less, it is preferable that the surface of the rubber belt 26 is smooth, which improves the adhesion therebetween and increases the contact area, and results in an increase in the friction coefficient. Therefore, when the smoothness of the inner surface of the rubber belt 26 is high and S1+S2=13 $\mu$m Rz or less, the uneven image transfer due to rise and shift of the rubber belt 26 does not occur.

On the contrary, when the rubber belt 26 and the aluminum drum 25 both have a high surface roughness, a good friction can be obtained.

This is caused by the projections 25*a* and 26*a* on the surfaces of the rubber belt 26 and the aluminum drum 25, which engage with each other to increase the friction coefficient.

In a region where S1 is 10 $\mu$m Rz or more, if S1+S2>30 $\mu$m Rz, an uneven image transfer due to rise and shift of the rubber belt 26 does not occur. In a region where the hardness of the rubber belt 26 is a little lower, the suitable scope of the surface roughness of the aluminum drum 25 and the inner surface of the rubber belt 26 is a little different from the above.

Tables 8 and 9 (shown in page 27, 28) represent the evaluation of the occurrence of an uneven image transfer due to rise and shift of the rubber belt 26 in printing a complete image on 100 sheets serially with use of samples having a hardness at 50 and 58 degrees and a thickness 0.5 mm, a 100% tensile stress of 55 kgf/cm$^2$ is used when the ratio P of the inner diameter of the rubber belt 26 and the outer diameter of the aluminum drum 25 is set at 1.04 and the surface roughness S1 of the aluminum drum 25 is changed within a scope of 2 to 20 $\mu$m Rz, and the surface roughness S2 of the inner surface of the rubber belt 26 is changed within a scope of 2 to 30 $\mu$m Rz, by polishing with use of sandblast or the like the outer surface of the aluminum drum 25 and the inner surface of the rubber belt 26.

In a region where the hardness of the rubber belt 26 is 60 degrees or less, even if the surface of the rubber belt 26 and the aluminum drum 25 is rough more or less, the rubber is deformed and adheres to the aluminum drum 25, and thus a high friction coefficient can be obtained. In such a region, a shift between the aluminum drum 25 and the rubber belt 26 does not occur. In the region where the aluminum drum 25 is 6 $\mu$m or less, and S1+S2=20 $\mu$m Rz or less, an uneven image transfer due to rise and shift of the rubber belt 26 does not occur.

Also in the case where the rubber belt 26 and the aluminum drum 25 both have a high surface roughness, a good friction can be obtained similarly in the case where the hardness is set within a scope of 60 to 80 degrees. In this case, the suitable scope of the surface roughness is not changed so much compared with the case of a hardness of 60 degrees or more. If S1 is 10 $\mu$m Rz or more, S1+S2>30 $\mu$m Rz, an uneven image transfer due to rise and shift of the rubber belt 26 does not occur.

In the first embodiment, the intermediate transfer body 7 is operated with a relatively small load.

The intermediate transfer body 7 and the photosensitive body belt 2 have respective driving sources, and thus no force is normally applied in theory between the surface of the photosensitive body belt 2 and the surface of the intermediate transfer body 7 in the condition where the relative speed is 0.

Similarly, no control operation such as a feedback wherein patches are printed on the photosensitive body belt 2 and the intermediate transfer body 7 to read the image density in order to change the image forming condition and control the image density, is performed in the embodiment.

TABLE 1

| | | Rubber belt hardness (JIS-A) | | | | | |
|---|---|---|---|---|---|---|---|
| | | 50 | 63 | 71 | 80 | 85 | 90 |
| Secondary | 7 | ○ | ○ | ○ | ○ | ○ | X |
| transfer | 12 | ○ | ○ | ○ | ○ | X | X |
| load | 20 | ○ | ○ | ○ | ○ | X | X |
| (gf/cm) | 24 | ○ | ○ | ○ | ○ | X | X |
| | 30 | ○ | ○ | ○ | ○ | X | X |

TABLE 2

| | | Rubber belt hardness (JIS-A) 40 degree | | | | | | | |
|---|---|---|---|---|---|---|---|---|---|
| | | R/r | | | | | | | |
| | | 1.01 | 1.03 | 1.05 | 1.1 | 1.13 | 1.15 | 1.17 | 1.2 |
| 100% | 25 | X | X | X | X | X | X | X | X |
| tensile | 40 | X | ○ | ○ | ○ | ○ | ○ | X | X |
| stress | 65 | X | ○ | ○ | ○ | ○ | ○ | X | X |
| (kgf/cm$^{-2}$) | 100 | X | ○ | ○ | ○ | ○ | ○ | X | X |

TABLE 3

| | | Rubber belt hardness (JIS-A) 60 degree | | | | | | | |
|---|---|---|---|---|---|---|---|---|---|
| | | R/r | | | | | | | |
| | | 1.01 | 1.03 | 1.05 | 1.1 | 1.13 | 1.15 | 1.17 | 1.2 |
| 100% | 25 | X | X | X | X | X | X | X | X |
| tensile | 40 | X | ○ | ○ | ○ | ○ | ○ | X | X |

TABLE 3-continued

| | | Rubber belt hardness (JIS-A) 60 degree | | | | | | | |
|---|---|---|---|---|---|---|---|---|---|
| | | R/r | | | | | | | |
| | | 1.01 | 1.03 | 1.05 | 1.1 | 1.13 | 1.15 | 1.17 | 1.2 |
| stress | 65 | X | ○ | ○ | ○ | ○ | ○ | X | X |
| (kgf/cm$^{-2}$) | 100 | X | ○ | ○ | ○ | ○ | ○ | ○ | X |

TABLE 4

| | | Rubber belt hardness (JIS-A) 80 degree | | | | | | | |
|---|---|---|---|---|---|---|---|---|---|
| | | R/r | | | | | | | |
| | | 1.01 | 1.03 | 1.05 | 1.1 | 1.13 | 1.15 | 1.17 | 1.2 |
| 100% | 25 | X | X | X | X | X | X | X | X |
| tensile | 40 | X | ○ | ○ | ○ | ○ | ○ | X | X |
| stress | 65 | X | ○ | ○ | ○ | ○ | ○ | X | X |
| (kgf/cm$^{-2}$) | 100 | X | ○ | ○ | ○ | ○ | ○ | ○ | X |

TABLE 5

| Rubber belt thickness and uneven transfer image | | |
|---|---|---|
| Thickness | Early stage image | Image after left 1 month |
| 0.15 | ○ | X |
| 0.22 | ○ | ○ |
| 0.45 | ○ | ○ |
| 0.8 | ○ | ○ |

TABLE 6

| | | Belt hardness 64 degree | | | | | | | | | | | |
|---|---|---|---|---|---|---|---|---|---|---|---|---|---|
| | | Belt rear surface roughness (μmRZ) | | | | | | | | | | | |
| | | 2.1 | 3.3 | 6.2 | 7 | 8 | 8.7 | 10.3 | 12.5 | 15 | 20 | 24 | 30 |
| Cylinder | 2.01 | ○ | ○ | ○ | ○ | ○ | ○ | X | X | X | X | X | X |
| surface | 3.4 | ○ | ○ | ○ | ○ | ○ | X | X | X | X | X | X | X |
| roughness | 4.9 | ○ | ○ | ○ | ○ | X | X | X | X | X | X | X | X |
| (μmRZ) | 5.8 | ○ | ○ | ○ | X | X | X | X | X | X | X | X | X |
| | 6.2 | ○ | ○ | X | X | X | X | X | X | X | X | X | X |
| | 8.5 | X | X | X | X | X | X | X | X | X | X | X | X |
| | 10.2 | X | X | X | X | X | X | X | X | X | ○ | ○ | ○ |
| | 12 | X | X | X | X | X | X | X | X | X | ○ | ○ | ○ |
| | 18.3 | X | X | X | X | X | X | X | ○ | ○ | ○ | ○ | ○ |
| | 20 | X | X | X | X | X | X | ○ | ○ | ○ | ○ | ○ | ○ |

TABLE 7

| | | Belt hardness 78 degree | | | | | | | | | | | |
|---|---|---|---|---|---|---|---|---|---|---|---|---|---|
| | | Belt rear surface roughness (μmRZ) | | | | | | | | | | | |
| | | 2 | 3.5 | 5.8 | 7 | 7.6 | 8.7 | 10.1 | 12.2 | 15 | 20.3 | 23.8 | 29.8 |
| Cylinder | 2.01 | ○ | ○ | ○ | ○ | ○ | ○ | X | X | X | X | X | X |
| surface | 3.4 | ○ | ○ | ○ | ○ | ○ | X | X | X | X | X | X | X |
| roughness | 4.9 | ○ | ○ | ○ | ○ | X | X | X | X | X | X | X | X |
| (μmRZ) | 5.8 | ○ | ○ | ○ | X | X | X | X | X | X | X | X | X |
| | 6.2 | ○ | ○ | X | X | X | X | X | X | X | X | X | X |

TABLE 7-continued

| | Belt hardness 78 degree | | | | | | | | | | | | |
|---|---|---|---|---|---|---|---|---|---|---|---|---|---|
| | Belt rear surface roughness (μmRZ) | | | | | | | | | | | | |
| | | 2 | 3.5 | 5.8 | 7 | 7.6 | 8.7 | 10.1 | 12.2 | 15 | 20.3 | 23.8 | 29.8 |
| | 8.5 | X | X | X | X | X | X | X | X | X | X | X | X |
| | 10.2 | X | X | X | X | X | X | X | X | X | ○ | ○ | ○ |
| | 12 | X | X | X | X | X | X | X | X | X | ○ | ○ | ○ |
| | 18.3 | X | X | X | X | X | X | X | ○ | ○ | ○ | ○ | ○ |
| | X | X | X | X | X | X | ○ | ○ | ○ | ○ | ○ | ○ | |

TABLE 8

| | Belt hardness 50 degree | | | | | | | | | | | | |
|---|---|---|---|---|---|---|---|---|---|---|---|---|---|
| | Belt rear surface roughness (μmRZ) | | | | | | | | | | | | |
| | | 2.1 | 3.4 | 6.2 | 6.9 | 8 | 8.7 | 10.3 | 12.3 | 14.8 | 20 | 24 | 29.9 |
| Cylinder surface roughness (μmRZ) | 2.01 | ○ | ○ | ○ | ○ | ○ | ○ | X | X | X | X | X | X |
| | 3.4 | ○ | ○ | ○ | ○ | ○ | X | X | X | X | X | X | X |
| | 4.9 | ○ | ○ | ○ | ○ | X | X | X | X | X | X | X | X |
| | 5.8 | ○ | ○ | ○ | X | X | X | X | X | X | X | X | X |
| | 6.2 | ○ | ○ | X | X | X | X | X | X | X | X | X | X |
| | 8.5 | X | X | X | X | X | X | X | X | X | X | X | X |
| | 10.2 | X | X | X | X | X | X | X | X | X | ○ | ○ | ○ |
| | 12 | X | X | X | X | X | X | X | X | X | ○ | ○ | ○ |
| | 18.3 | X | X | X | X | X | X | X | ○ | ○ | ○ | ○ | ○ |
| | 20 | X | X | X | X | X | X | ○ | ○ | ○ | ○ | ○ | ○ |

TABLE 9

| | Belt hardness 58 degree | | | | | | | | | | | | |
|---|---|---|---|---|---|---|---|---|---|---|---|---|---|
| | Belt rear surface roughness (μmRZ) | | | | | | | | | | | | |
| | | 2.1 | 3.5 | 5.8 | 7.1 | 7.6 | 8.7 | 9.9 | 12.2 | 15.1 | 20.3 | 24.1 | 29.8 |
| Cylinder surface roughness (μmRZ) | 2.01 | ○ | ○ | ○ | ○ | ○ | ○ | X | X | X | X | X | X |
| | 3.4 | ○ | ○ | ○ | ○ | ○ | X | X | X | X | X | X | X |
| | 4.9 | ○ | ○ | ○ | ○ | X | X | X | X | X | X | X | X |
| | 5.8 | ○ | ○ | ○ | X | X | X | X | X | X | X | X | X |
| | 6.2 | ○ | ○ | X | X | X | X | X | X | X | X | X | X |
| | 8.5 | X | X | X | X | X | X | X | X | X | X | X | X |
| | 10.2 | X | X | X | X | X | X | X | X | X | ○ | ○ | ○ |
| | 12 | X | X | X | X | X | X | X | X | X | ○ | ○ | ○ |
| | 18.3 | X | X | X | X | X | X | X | ○ | ○ | ○ | ○ | ○ |
| | 20 | X | X | X | X | X | X | ○ | ○ | ○ | ○ | ○ | ○ |

Figure 9:
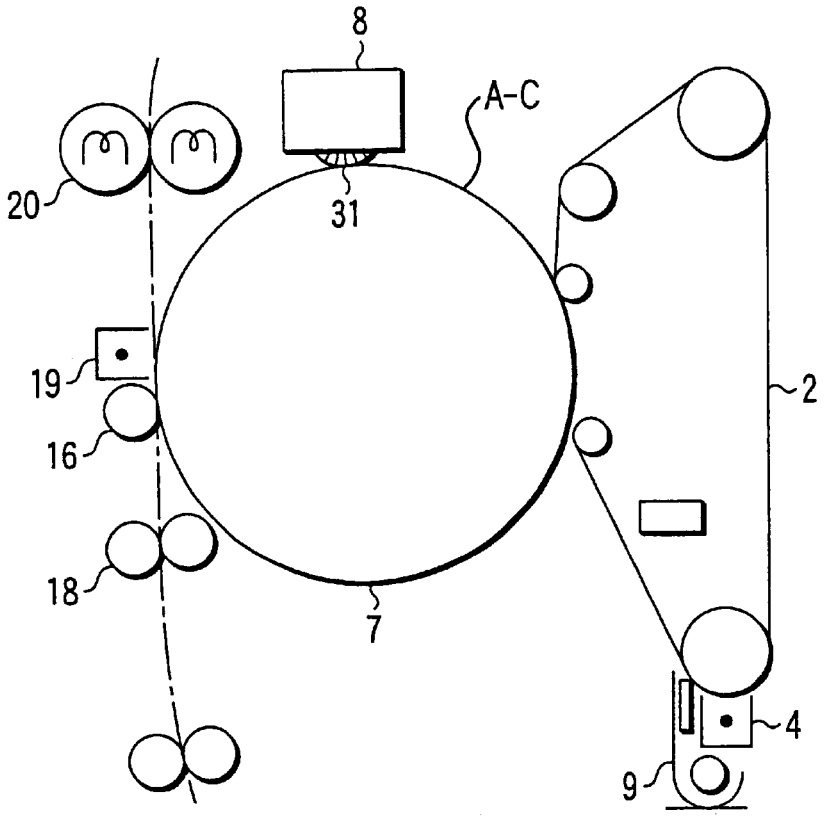
FIG. 9 is a schematic view showing an image forming section according to the second embodiment of the present invention.

FIG. 9 shows a schematic view of the apparatus according to the second embodiment.

The same portions as those shown in the first embodiment are denoted by the same reference numerals, and the description of them will be omitted.

In the second embodiment, the intermediate transfer body 7 has no specific driving source, and is formed to be rotated in accordance with the photo-sensitive body belt 2. With this structure, the rotating speeds of the photosensitive body belt 2 and the intermediate transfer body are substantially equal to each other, and the color image with remarkably little shift can be obtained.

However, the intermediate transfer body 7 has no driving source, and thus a blade cannot be used as a cleaner for the intermediate transfer body 7 since a blade will cause a large driving load. Accordingly, a brush 31 to which a bias voltage is applied is used as a cleaner for the intermediate transfer body 7, in this embodiment.

By replacing the cleaner with the brush 31, the force applied to the surface of the intermediate transfer body 7 is decreased. It is thus thought that an uneven image transfer due to rise and shift of the rubber belt 26 may not occur with ease. However, the influence of the force applied to the surface of the intermediate transfer body 7 when the photosensitive body is driven is very large. Therefore, an uneven image transfer due to rise and shift of the rubber belt 26 will easily occur in this structure.

When 100 sheets are serially printed with use of the intermediate transfer body 7 covered with the rubber belts A to C in which no problem will occur in the first embodiment, no uneven image transfer occurs. The properties of the rubber belts A to C will be described later.

However, when the 100 sheet printing is performed intermittently for every other sheet, a force causing the shift between the rubber belts A to C and the aluminum drums 25 is applied every time the photosensitive body belt 2 and the intermediate transfer body 7 are rotated and stopped. As a result, the rubber belt 26 is shifted from the aluminum drum 25, and an uneven image transfer occurs. In order to compare the structures, the apparatus according to the first embodiment with use of the rubber belts A to C is used to print 100 sheets intermittently for every other sheet, but no uneven image transfer occurs due to the shift of the rubber belts A to C.

The rubber belt A has a hardness of 60 degrees, a 100% tensile stress of 48 kgf/cm$^2$, R/r of 1.05, S1 of 0.35 $\mu$m Rz, and S2 of 1.1 $\mu$m Rz.

The rubber belt B has a hardness of 58 degrees, a 100% tensile stress of 42 kgf/cm$^2$, R/r of 1.05, S1 of 0.35 $\mu$m Rz, and S2 of 1.1 $\mu$m Rz.

The rubber belt C has a hardness of 65 degrees, a 100% tensile stress of 50 kgf/cm$^2$, R/r of 1.05, S1 of 0.65 $\mu$m Rz, and S2 of 2.5 $\mu$m Rz.

Table 10 (shown in page 32) represents the evaluation of the occurrence of an uneven image transfer in printing 100 sheets intermittently for every other sheet, with use of rubber belts having a hardness within a scope of 60 to 80 degrees and a 100% tensile stress under the conditions where the thickness of the rubber belts is 0.5 mm, R/r=1.05, S1=0.35, and S2=0.9–1.1. This table shows that when the 100% tensile stress is set at 60 kgf/cm$^2$ or more, no uneven image transfer occurs.

Table 11 (shown in page 33) represents the evaluation of the occurrence of an uneven image transfer in printing 100 sheets intermittently for every other sheet, with use of rubber belts having a hardness within a scope of 60 to 80 degrees and a 100% tensile stress under the conditions where the thickness t of the rubber belts 26 is 0.5 mm, R/r=1.05, S1=0.55, and S2=1.1–1.4. This table shows that when the 100% tensile stress is set at 60 kgf/cm$^2$ or more, no uneven image transfer occurs.

Table 12 (shown in page 33) represents the evaluation of the occurrence of an uneven image transfer in printing 100 sheets intermittently for every other sheet, with use of rubber belts having various harnesses and various values of a 100% tensile stress, under the conditions where the thickness t of the rubber belts 26 is 0.5 mm, R/r=1.05, S1=1.2, and S2=2.1–2.6. This table shows that when the 100% tensile stress is set at a large value, an improvement of the uneven image transfer can be attained. More specifically, when the 100% tensile stress is set at 60 kgf/cm$^2$ or more, no uneven image transfer occurs.

As should be clear from the above, in the apparatus wherein the intermediate transfer body 7 has no driving source and is rotated in accordance with the photosensitive body belt 2, a large shifting force is applied to the rubber belt 26 during rotation, and thus the rubber belt 26 having a larger 100% tensile stress needs to be used to cover the intermediate transfer body therewith, in comparison with the case where the intermediate transfer body 7 has a driving source.

TABLE 10

| Belt No. | S2 | Hardness | 100% tensile stress (kgf/cm$^2$) | Image |
|---|---|---|---|---|
| 4 | 0.9 | 65 | 55 | X |
| 5 | 0.9 | 69 | 63 | ○ |
| 6 | 1.1 | 76 | 70 | ○ |
| 7 | 0.9 | 70 | 52 | X |
| 8 | 1.1 | 68 | 66 | ○ |

TABLE 11

| Belt No. | S2 | Hardness | 100% tensile stress (kgf/cm$^2$) | Image |
|---|---|---|---|---|
| 9 | 1.1 | 65 | 55 | X |
| 10 | 1.3 | 69 | 63 | ○ |
| 11 | 1.2 | 76 | 70 | ○ |
| 12 | 1.4 | 57 | 52 | X |
| 13 | 1.2 | 58 | 66 | ○ |

TABLE 12

| Belt No. | S2 | Hardness | 100% tensile stress (kgf/cm$^2$) | Image |
|---|---|---|---|---|
| 11 | 2.1 | 65 | 56 | X |
| 12 | 2.2 | 69 | 62 | ○ |
| 13 | 2.1 | 76 | 74 | ○ |
| 14 | 2.6 | 57 | 46 | X |
| 15 | 2.4 | 58 | 56 | X |
| 16 | 2.5 | 55 | 65 | ○ |
| 17 | 2.2 | 57 | 80 | ○ |

Next, the third embodiment of the present invention will be described.

In the third embodiment, the photosensitive body belt 2 and the intermediate transfer body 7 have respective driving sources. The intermediate transfer body 7 is provided with the cleaning blade 28 as a cleaner. The other structures of the apparatus of this embodiment are the same as those of the first embodiment. The apparatus of the third embodiment is different from the apparatus of the first embodiment only in the point that the pressing condition of the cleaning blade 28 against the intermediate transfer body 7 is adjusted in accordance with the image density control.

Figure 10:
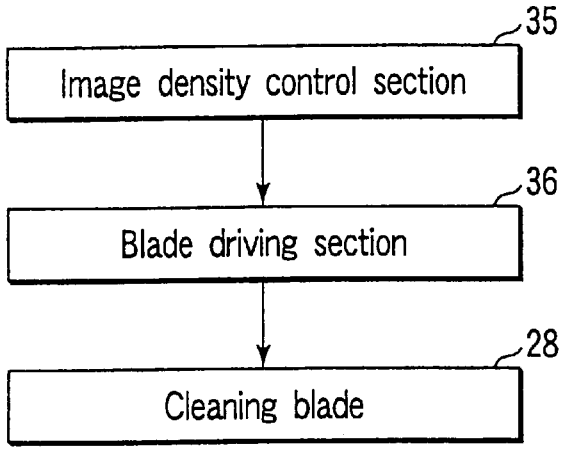
FIG. 10 is a block diagram showing a driving system of a cleaning blade according to the third embodiment.

As shown in FIG. 10, the apparatus of the third embodiment is provided with an image density control section 35. The image density control section 35 is connected to a blade driving section 36 through a control circuit.

When the image density control section 35 controls the image density, the pressing force of the cleaning blade 28 against the intermediate transfer body 7 is adjusted in accordance with the image density control Normally, the cleaner of the intermediate transfer body 7 is required to clean the remaining transfer toner in order to prevent the next image being dirtied. When a jam occurs in the apparatus, although it is a rare case, the entire image on the intermediate transfer body 7 has to be cleaned, and thus the cleaning load becomes larger. However, during the jam recovery operation, the cleaning is performed in several rotations of the intermediate transfer body 7, and thus a high cleaning performance is not required.

Accordingly, with the pressing load within a scope of 1.4–3.0 gf/mm, the cleaning blade 28 can perform good cleaning. When the cleaning blade 28 is pressed with a pressure over 3.0 gf/mm, the blade 28 may be lifted or the surface of the intermediate transfer body 7 may be damaged. However, image density control is performed in the third embodiment, and thus the cleaning blade 28 must have a high pressing force compared with that of a cleaner merely required to clean the remaining transfer toner.

The present embodiment is intended to print a patch image of 0.2–0.9 cm$^2$ for each of colors Y, M, C, and K at the start of image forming or before feeding sheets, transfer the image to the intermediate transfer body 7, read the density of the patch image, 4 and change the charging potential of the photosensitive body belt 2, the bias voltage for developing, and the exposure amount of the laser in accordance with the read density, thereby attain a constant image density.

The amount of the remaining toner of the primary transfer is as low as 0.2 mg/cm$^2$. However, the amount of the remaining toner of the secondary transfer reaches 0.9 mg/cm$^2$, and thus the proper pressing force of the cleaning blade 28 should be set within a scope of 2–3.0 gf/mm. In this embodiment, the pressing force of the cleaning blade 28 should be set within a scope of 2.3 gf/mm.

Table 13 (shown in page 38) represents the evaluation of the occurrence of an uneven image transfer in printing 100 sheets intermittently for every other sheet, with use of the rubber belt 26 having various harnesses and various values of a 100% tensile stress is used in the condition where R/r=1.05, S1=0.35, and S2=0.9–1.1.

When the hardness of the rubber belt 26 is 60 degrees or less, even if the 100% tensile stress is set at a large value, the uneven image transfer cannot be improved. More specifically, the rubber belt 26 having low hardness generates a hollow on a contact face with the cleaning blade 28, and both sides of the hollow may easily rise. When the rotating force of the intermediate transfer body 7 is applied to the hollow, the aluminum drum 25 and the rubber belt 26 will from shifted to each other.

On the other hand, if the hardness of the rubber belt 26 is 60 degree or more, when the 100% tensile stress is set at 60 kgf/cm$^2$ or more, no uneven image transfer occurs.

Table 14 (shown in page 38) represents the evaluation of the occurrence of an uneven image transfer in printing 100 sheets intermittently for every other sheet, with use of the rubber belt 26 having various harnesses and various values of a 100% tensile stress is used in the condition where R/r=1.05, S1=0.75, and S2=2.3 to 2.6.

When the hardness of the rubber belt 26 is 60 degrees or less, even if the 100% tensile stress is set at a large value, an uneven image transfer cannot be improved. More specifically, the rubber belt 26 having a low hardness generates a hollow on a contact face with the cleaning blade 28, and both sides of the hollow may easily rise. When the rotating force of the intermediate transfer body 7 is applied to the hollow, the aluminum drum 25 and the rubber belt 26 will be shifted from each other.

On the other hand, if the hardness of the rubber belt 26 is 60 degree or more, when the 100% tensile stress is set at 60 kgf/cm$^2$ or more, no uneven image transfer occurs.

As should be clear from the above, in the image forming apparatus wherein the cleaning blade 28 is pressed with a pressing force of 2 gf/mm against the intermediate transfer body 7, the hardness of the rubber belt 26 should be set at 60s degree or more, and the 100% tensile stress also should be set at 60 kgf/cm$^2$ or more.

TABLE 13

| Belt No. | Hardness | 100% tensile stress (kgf/cm$^2$) | Image |
|---|---|---|---|
| 4 | 65 | 75 | X |
| 5 | 69 | 83 | ○ |
| 6 | 76 | 90 | ○ |
| 7 | 57 | 72 | X |
| 8 | 58 | 86 | X |
| 9 | 55 | 95 | X |
| 10 | 57 | 120 | X |

TABLE 14

| Belt No. | Hardness | 100% tensile stress (kgf/cm$^2$) | Image |
|---|---|---|---|
| 11 | 65 | 56 | X |
| 12 | 69 | 62 | ○ |
| 13 | 76 | 74 | ○ |
| 14 | 57 | 46 | X |
| 15 | 58 | 56 | X |
| 16 | 55 | 65 | X |
| 17 | 57 | 80 | X |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A transferring body apparatus comprising a cylindrical base and an elastic member covering the cylindrical base therewith on which an image is transferred, wherein the elastic member has a hardness (JIS-A) of 60 to 80 degrees, a thickness of 0.2–0.8 mm, a tensile stress of 40 kgf/cm$^2$ or more, supposing an outer diameter of the base is R, and an inner diameter of the elastic member is r, $$1.03 \leqq R/r \leqq 1.15$$

is satisfied, and supposing a surface roughness of the outer surface of the base is S1 $\mu$m Rz, and surface roughness of the inner surface of the elastic member is S2 $\mu$m Rz, $$S1+S2 \leqq 12$$

$$S1 \leqq 5$$

are satisfied.

2. The transferring body apparatus according to claim 1, wherein the transferring body apparatus is provided for an image forming apparatus having a rotating image carrier and carrying an image on the image carrier, rotated in accordance with the rotation of the image carrier, and temporarily holds the image on the image carrier such that the image is transferred onto the elastic member having a tensile stress of 60 kgf/cm$^2$ or more, then transfers the image onto an object to be transferred.

3. The transferring body apparatus according to claim 1, wherein the transferring body apparatus is provided for an image forming apparatus having a rotating image carrier and carrying an image on the image carrier, and temporarily holds the image on the image carrier such that the image is transferred onto the elastic member having a hardness (JIS-A) of 60 to 80 degrees and a tensile stress of 60 kgf/cm$^2$ or more, transfers the image onto an object to be transferred, and removes developing agent remaining on the elastic member after transferring the image with use of a cleaning blade contacting with a pressing force of 2 gf/cm or more against the elastic member.

4. The transferring body apparatus according to claim 1, wherein the volume resistance value of the base and the elastic member is set within a scope of $10^8$ Ω to $10^{12}$ Ωcm.

5. A transferring body apparatus comprising a cylindrical base and an elastic member covering the cylindrical base therewith on which an image is transferred, wherein the elastic member has a hardness (JIS-A) of 60 degrees or less, a thickness of 0.2–0.8 mm, a tensile stress of 40 kgf/cm$^2$ or more, supposing an outer diameter of the base is R, and an inner diameter of the elastic member is r, $$1.03 \leqq R/r \leqq 1.15$$

is satisfied, and supposing a surface roughness of the outer surface of the base is S1 μm Rz, and a surface roughness of the inner surface of the elastic member is S2 μm Rz, $$S1+S2 \leqq 20$$

$$S1 \leqq 6$$

are satisfied.

6. The transferring body apparatus according to claim 5, wherein the transferring body apparatus is provided to an image forming apparatus having a rotating image carrier and carrying an image on the image carrier, rotated in accordance with the rotation of the image carrier, and temporarily holds the image on the image carrier such that the image is transferred onto the elastic member having a tensile stress of 60 kgf/cm$^2$ or more, then transfers the image onto an object to be transferred.

7. The transferring body apparatus according to claim 5, wherein the volume resistance value of the base and the elastic member is set within a scope of $10^8$ Ω to $10^{12}$ Ωcm.

8. A transferring body apparatus comprising a cylindrical base and an elastic member covering the cylindrical base therewith onto which an image is transferred, wherein the elastic member has a hardness (JIS-A) of 80 degrees or less, a thickness of 0.2–0.8 mm, a tensile stress of 40 kgf/cm$^2$ or more, supposing an outer diameter of the base is R, and an inner diameter of the elastic member is r, $$1.03 \leqq R/r \leqq 1.15$$

is satisfied, and supposing a surface roughness of the outer surface of the base is S1 μm Rz, and a surface roughness of the inner surface of the elastic member is S2 μm Rz, $$S1+S2 \geqq 30$$

$$S1 \geqq 10$$

are satisfied.

9. The transferring body apparatus according to claim 8, wherein the transferring body apparatus is provided for an image forming apparatus having a rotating image carrier and carrying an image on the image carrier, rotated in accordance with the rotation of the image carrier, and temporarily holds the image on the image carrier such that the image is transferred onto the elastic member having a tensile stress of 60 kgf/cm$^2$ or more, then transfers the image onto an object to be transferred.

10. The transferring body apparatus according to claim 8, wherein the transferring body apparatus is provided for an image forming apparatus having a rotating image carrier and carrying an image on the image carrier, and temporarily holds the image on the image carrier such that the image is transferred onto the elastic member having a hardness (JIS-A) of 60 to 80 degrees and a tensile stress of 60 kgf/cm$^2$ or more, transfers the image onto an object to be transferred, and removes developing agent remaining on the elastic member after transferring the image with use of a cleaning blade contacting with a pressing force of 2 gf/cm or more against the elastic member.

11. The transferring body apparatus according to claim 8, wherein the volume resistance value of the base and the elastic member is set within a scope of $10^8$ Ω to $10^{12}$ Ωcm.

* * * * *